US006246372B1

(12) United States Patent
Egawa et al.

(10) Patent No.: US 6,246,372 B1
(45) Date of Patent: Jun. 12, 2001

(54) EXTENDABLE WHIP ANTENNA

(75) Inventors: Kiyoshi Egawa; Masazumi Yamazaki, both of Yokosuka; Yoshio Koyanagi, Ebina; Hidehiro Yanagibashi, Yokohama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/445,429

(22) PCT Filed: Apr. 26, 1999

(86) PCT No.: PCT/JP99/02191

§ 371 Date: Dec. 10, 1999

§ 102(e) Date: Dec. 10, 1999

(87) PCT Pub. No.: WO99/56343

PCT Pub. Date: Nov. 4, 1999

(30) Foreign Application Priority Data

Apr. 28, 1998 (JP) ..... 10-119557

(51) Int. Cl.[7] ..... H01Q 1/24
(52) U.S. Cl. ..... 343/702; 343/895
(58) Field of Search ..... 343/702, 895, 343/900, 901, 715

(56) References Cited

U.S. PATENT DOCUMENTS 5,438,339 * 8/1995 Itoh et al. ..... 343/702
5,469,177 * 11/1995 Rush et al. ..... 343/702
5,521,605 * 5/1996 Koike ..... 343/702
5,606,327 * 2/1997 Elliott et al. ..... 343/702

FOREIGN PATENT DOCUMENTS 5-343907 12/1993 (JP) .
8-195615 7/1996 (JP) .

OTHER PUBLICATIONS

English language abstract of JP 8–195615.
English language abstract of JP 5–343907.

* cited by examiner

*Primary Examiner*—Tan Ho
(74) *Attorney, Agent, or Firm*—Greenblum & Bernstein, P.L.C.

(57) ABSTRACT

In a state that a whip antenna is contained in a housing of a cellular phone, a minute space is formed between a feeding spring and an attaching member conductive to a helical antenna base portion, so as to generate electrostatic capacitance, which is equivalent to the impedance characteristic of a mono-pole antenna. Then, electrostatic capacitance and a coil portion of a helical antenna constitute an LC series resonance circuit so as to improve the wide band of the helical antenna.

8 Claims, 4 Drawing Sheets

EXTENDABLE WHIP ANTENNA

TECHNICAL FIELD

The present invention relates to an antenna apparatus for use in a cellular phone, a mobile radio communication apparatus, etc.

BACKGROUND ART

As an example of an antenna apparatus for use in a mobile radio communication apparatus, a whip antenna, which is used in a cellular phone, can be named.

As shown in FIG. 1, a cellular phone 2, which comprises a whip antenna 1, has an antenna configuration in which a call can be established even in a state that a whip antenna 1 is extended or contained.

In a case of a bad receiving and transmitting state, a user of cellular phone 2 extends whip antenna 1 from a main body of cellular phone 2 to improve the receiving and transmitting state, so that the user can make a call. Also, when the extended whip antenna 1 obstructs the carrying or the telephone call in a good receiving and transmitting state, the user of cellular phone 2 contains the whip antenna 1 in the main body, so that the user can make a call.

FIGS. 2A and 2B are cross-sectional views showing the configuration of the conventional whip antenna used in the cellular phone. FIG. 2A shows a state that the whip antenna is extended from the main body, and FIG. 2B shows a state that whip antenna is contained in the main body.

As shown in FIGS. 2A and 2B, the conventional whip antenna 1 is attached to a housing 11 of the cellular phone 2 with an attaching member 12. The whip antenna 1 has a configuration in which a screw antenna 13 and a mono-pole antenna 14 are combined. The screw antenna 13 and mono-pole antenna 14 are electrically insulated from each other by an insulating member 15 inserted between these antennas.

As shown in FIG. 2A, when the whip antenna 1 is extended, a radio circuit substrate 16 is electrically connected to a mono-pole antenna base portion 18 through a feeding spring 17. At this time, a portion from radio circuit substrate 16 to mono-pole antenna 14 is conductive, and only mono-pole antenna 14 is electrically powered and functions as an antenna.

While, as shown in FIG. 2B, when the whip antenna 1 is contained in a housing 11 down to a portion where a resin mold 19 for protecting screw antenna 13 comes in contact with attaching member 12, radio circuit substrate 16 is electrically connected to a screw antenna base portion 20 through feeding spring 17. At this time, a portion from radio circuit substrate 16 to screw antenna 13 is conductive, and only screw antenna 13 is electrically powered and functions as an antenna.

In such an antenna apparatus for use in a mobile radio communication apparatus, there is a problem in widening the receiving and transmitting band, particularly the widening of the band of screw antenna 13. More specifically, in the current digital system cellular system in Japan, the distance between the transmitting band and the receiving band is 112 MHz, and the band necessary for the entirety of system is 148 MHz.

The following can be considered as one of solutions to widen screw antenna 13. Namely, a coil diameter of screw antenna 13, the pitch, the number of turns are optimized. Moreover, as shown in FIG. 2, the screw antenna base portion 20 is divided into two and a spacer 21, made of a dielectric material, is inserted therebetween, so that an LC series resonance circuit is formed. This equalizes the impedance characteristic of screw antenna 13 with that of mono-pole antenna 14.

Since the impedance characteristic of screw antenna 13 is equivalent to that of mono-pole antenna 14, screw antenna 13 connected to the radio circuit substrate 16, which matches mono-pole antenna 14, can obtain the same wide band characteristic as mono-pole antenna 14.

However, in the conventional whip antenna 1, both faces of spacer 21 must be bonded with an adhesive, etc., and there is a problem in which mechanical strength of the bonded portion is insufficient to bending and tension of whip antenna 1.

DISCLOSURE OF INVENTION

It is an object of the present invention to provide an antenna apparatus for use in a mobile radio communication apparatus, which can improve widen the band of a screw antenna as having mechanical strength sufficient to bending and tension of antenna.

The above object can be attained by the configuration in which electrostatic capacitance having an impedance characteristic equivalent to mono-pole antenna is generated between a feeder side and a screw antenna, and the electrostatic capacitance and a coil portion of the screw antenna constitute an LC series resonance circuit.

BEST MODE FOR CARRYING OUT THE INVENTION

The following will explain the best mode for carrying out the invention with reference to the drawings. In the explanation set forth below, a direction where a whip antenna of a cellular phone is attached is set to an upper side.

FIRST EMBODIMENT

Figure 1:
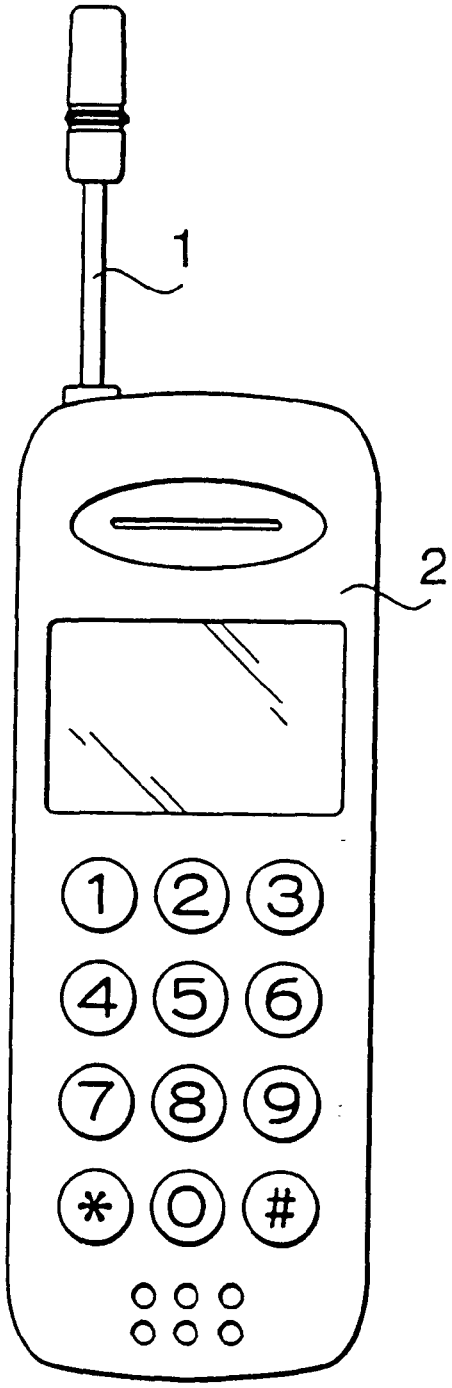
FIG. 1 is an outline view of a mobile radio communication apparatus.
Figure 2A:
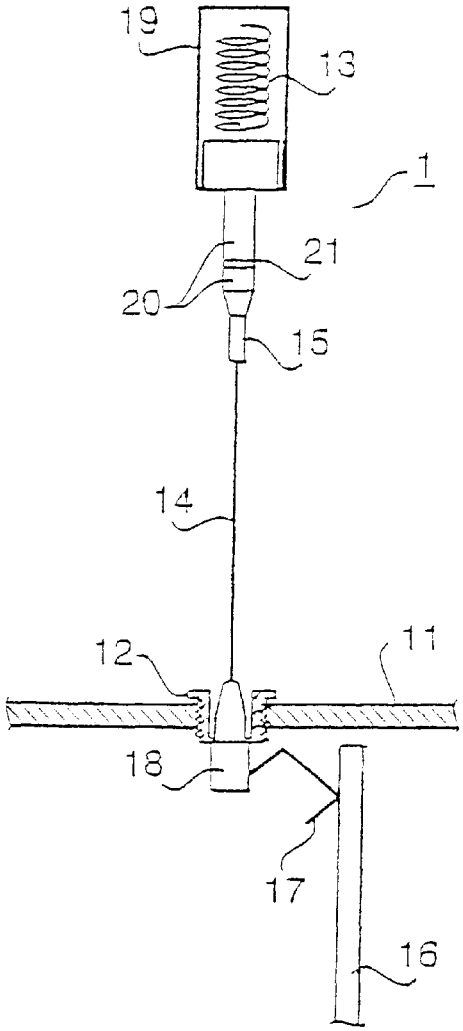
FIG. 2A PRIOR ART
FIG. 2A is a general cross-sectional view showing a state in which a conventional whip antenna is extended.
Figure 2B:
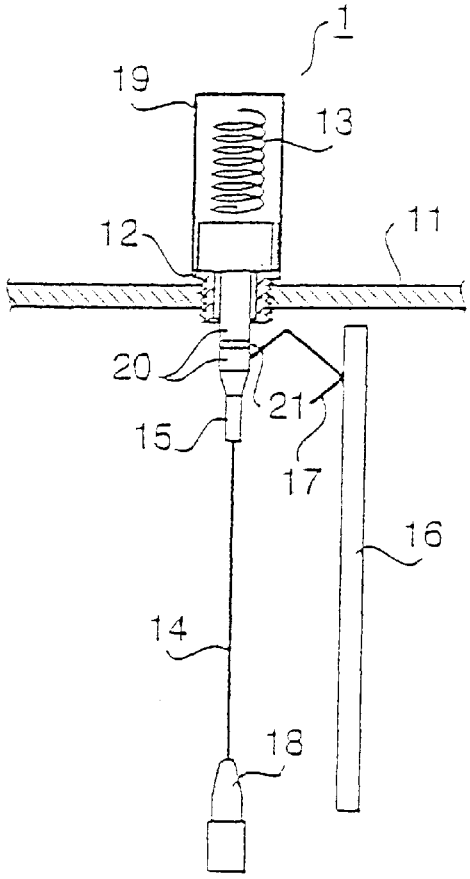
FIG. 2B PRIOR ART
FIG. 2B is a general cross-sectional view showing a state in which the conventional whip antenna is contained.
Figure 3A:
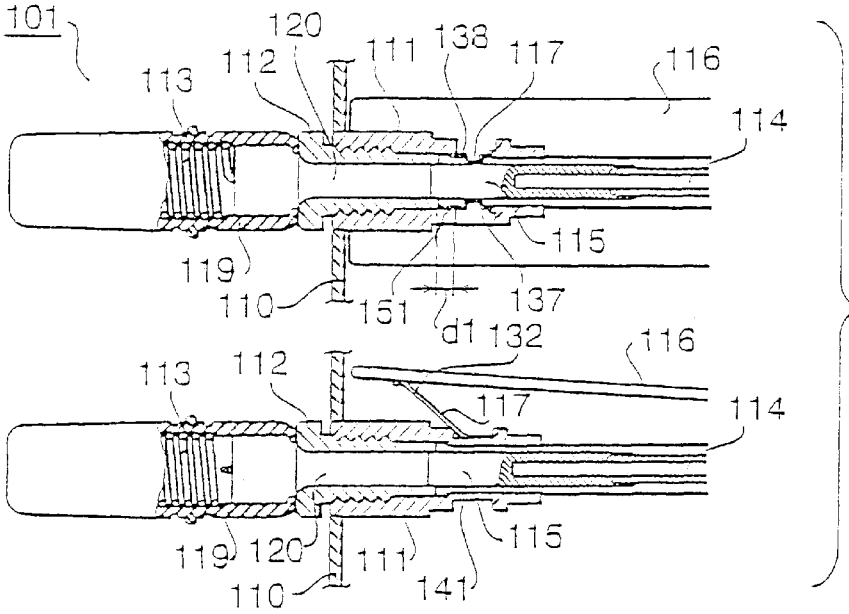
FIG. 3A is a general cross-sectional view showing a state in which a whip antenna according to a first embodiment of the present invention is contained.
Figure 3B:
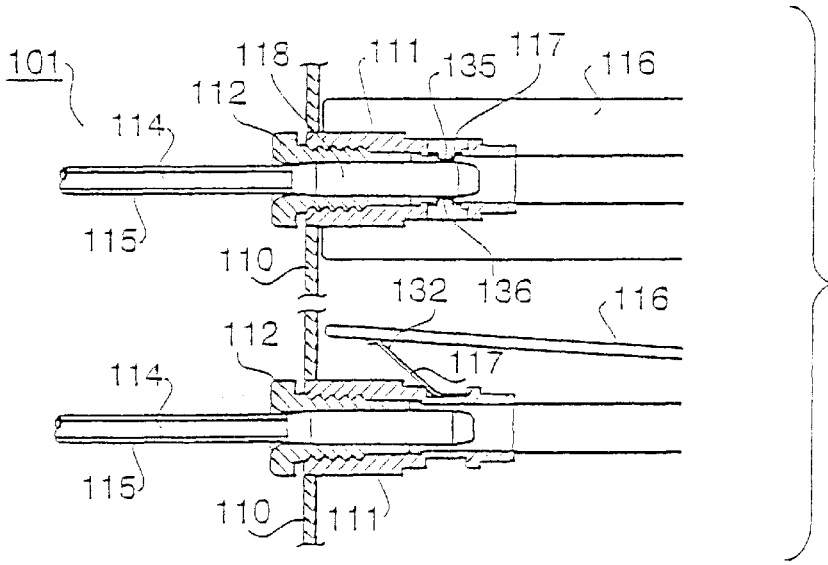
FIG. 3B is a general cross-sectional view showing a state in which the whip antenna according to the first embodiment of the present invention is extended.

FIGS. 3A and 3B are views showing the configuration of the whip antenna according to the embodiment of the present invention.

FIG. 3A shows a state in which the whip antenna is contained, and FIG. 3B shows a state in which the whip antenna is extended.

As shown in FIGS. 3A and 3B, a whip antenna101 is attached to a cellular phone by screwing an attaching member 112 into a holler 111 fixed to ahousing 110 of the cellular phobe.

Whip antenna 101 has a configuration in which a screw or helical antenna 113 and a mono-pole antenna 114 are combined. Screw or helical antenna 113 and mono-pole antenna 114 are electrically insulated from each other by an insulating member 115 inserted therebetween.

A radio circuit substrate 116 and a feeding spring 117 fixed to holder 111 are always in contact with each other and become conductive.

Figure 4:
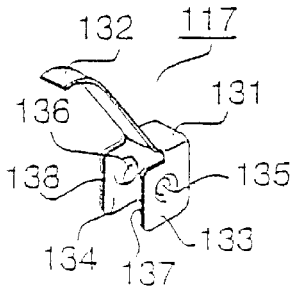
FIG. 4 is a perspective view showing the shape of a feeding spring used in the whip antenna according to the first embodiment of the present invention.

FIG. 4 is a perspective view showing the shape of the feeding spring 117 used in the whip antenna 101 according to the first embodiment of the present invention.

As shown in FIG. 4, feeding spring 117 has a shape in which a spring portion 132 is formed on an upper portion of a U-shaped central portion 131 of a main body having a conductive thin plate bent in a U-shape form. Also, the feeding spring 117 has projections 135 and 136 at the center of each of U-shaped ends 133 and 134 to be inwardly formed.

Feeding spring 117 is fit in a concave portion 141 of holder 111 so as to be fixed thereto. The feeding spring 117 comes in contact with radio circuit substrate 116 by spring portion 132 so as be conductive.

As shown in FIG. 3B, when the whip antenna 101 is extended, the projections 135 and 136 of feeding spring 117 and a mono-pole antenna base portion 118 are brought into contact with each other, radio circuit substrate 116 is electrically connected to mono-pole antenna 114 through feeding spring 117. At this time, a portion from radio circuit substrate 116 to mono-pole antenna 114 is conductive, and only mono-pole antenna 114 functions as an antenna.

While, as shown in FIG. 3A, when the whip antenna 101 is contained in a housing 110 down to a portion where a resin mold 119 for protecting screw or helical antenna 113 comes in contact with attaching member 112, a minute space d1 is formed between a lower end portion 151 of attaching member 112 and upper end portions 137 and 138 of U-shaped end portions 133 and 134 of feeding spring 117. For this reason, attaching member 112, which is conductive to a screw or helical antenna base portion 120, and feeding spring 117 are electrically insulated from each other.

At this time, electrostatic capacitance is generated at the portion of minute space d1. The electrostatic capacitance constitutes a coil portion of screw or helical antenna 113 and an LC series resonance circuit, and screw or helical antenna 113 functions as an antenna.

Here, the size of electrostatic capacitance is determined by minute space d1. Also, the position of attaching member 112 with respect to holder 111 is adjusted, so that a desired amount of minute space d1 can be easily set.

Therefore, in the state in which whip antenna 101 is contained in housing 110, minute space d1 is set to generate electrostatic capacitance, which is equivalent to the impedance characteristic of mono-pole antenna 114. This makes it possible to obtain screw antenna 113 having a wide band characteristic similar to mono-pole antenna 114.

Moreover, since it is unnecessary to insert the spacer to the screw antenna base portion to be fixed thereto, the antenna structure itself can be simplified as maintaining mechanical strength sufficient to bending and tension of antenna.

The first embodiment explained the structure in which minute space d1 was adjusted by screwing fixing member 112 into holder 111. However, the present invention is not limited to this structure. Namely, a plurality of attaching members 112 having a different length is prepared, and one is selected from these attaching members 112 and fit to holder 111, so that minute space d1 can be adjusted accurately and a desired amount of electrostatic capacitance can be obtained.

SECOND EMBODIMENT

Figure 5:
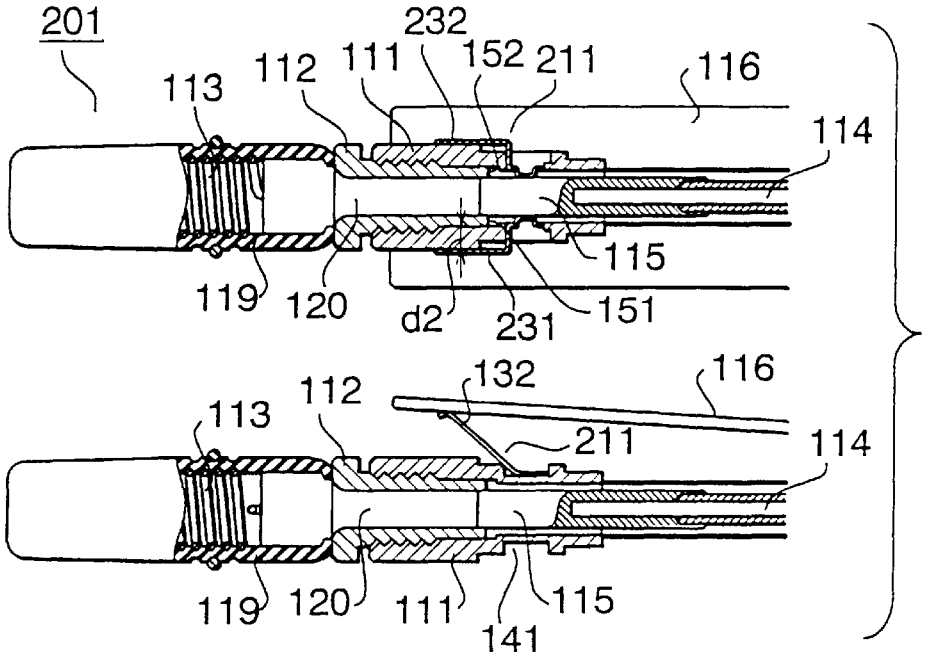
FIG. 5 is a general cross-sectional view showing a state in which the antenna apparatus for use in the mobile communication apparatus according to a second embodiment of the present invention.

FIG. 5 is a cross-sectional view showing the configuration of the whip antenna according to the second embodiment, and shows a state in which the whip antenna is contained. In FIG. 5, the same reference numerals as FIG. 3A are added to the portions common to FIG. 3A, and the explanation will be omitted.

Whip antenna 201 according to the second embodiment is different from whip antenna 101 according to the first embodiment in only the shape of the feeding spring.

Figure 6:
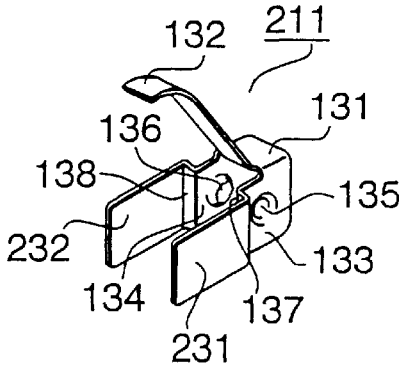
FIG. 6 is a perspective view showing the shape of the feeding spring used in the whip antenna according to the second embodiment of the present invention.

FIG. 6 is a perspective view showing the shape of whip antenna 201 used in whip antenna 202 according to the second embodiment. As compared with feeding spring 117, a feeding spring 211 has a shape in which plane electrodes 231 and 232, each having a predetermined width and being parallel to each other, are added to upper ends 137 and 138 of U-shaped end portions 133 and 134.

In a case where feeding spring 211 is attached to whip antenna 201, electrodes 231 and 232 are arranged to sandwich holder 111.

As a result, according to this embodiment, electrostatic capacitance is determined by a minute space d2 between a side surface 152 of attaching member 112 and feeding spring 211.

Since electrodes 231 and 232 sandwich holder 111, minute space d2 is determined by the thickness of holder 111. By adjusting only the thickness of holder 111, such electrostatic capacitance that is equivalent to the impedance characteristic of mono-pole antenna 114 can be stably and accurately obtained.

Then, similar to the first embodiment, since electrostatic capacitance constitutes the coil portion of screw or helical antenna 113 and LC series resonance circuit, screw or helical antenna 113 having the same wide band characteristic as mono-pole antenna 114 can be easily obtained.

As explained above, according to the antenna apparatus for use in the mobile radio communication apparatus of the present invention, electrostatic capacitance is generated in a space between a feeder and the screw or helical antenna, and electrostatic capacitance and the coil portion of the screw or helical antenna can constitute LC series resonance circuit. As a result, even in a state that the antenna is contained, the same wide band characteristic as the state in which the antenna is extended can be obtained.

Moreover, since it is unnecessary to insert the spacer to the screw or helical antenna base portion to be fixed thereto, the antenna structure itself can be simplified as maintaining mechanical strength sufficient to bending and tension of antenna.

This application is based on the Japanese Patent Application No. HEI 10-119557 filed on Apr. 28, 1998, entire content of which is expressly incorporated by reference herein.

INDUSTRIAL APPLICABILITY

The present invention is suitable to be used in the field of such as cellular phones, mobile radio communication apparatuses, etc.

What is claimed is:

1. An antenna apparatus for use in a mobile radio communication apparatus comprising:

an antenna having a helical antenna and a mono-pole antenna combined through an insulating member;

antenna attaching means for attaching said antenna to a main body of a mobile radio communication apparatus to be conductive to said helical antenna at the time of containing said antenna; and feeding means for feeding electrical power to said mono-pole antenna at the time of extending said antenna and forming capacitance with said antenna attaching means at the time of containing said antenna.

2. The antenna apparatus according to claim 1, wherein said antenna attaching means is screwed into a main body of the mobile radio communication apparatus to adjust an attaching position with respect to the main body of the mobile radio communication apparatus, so that a space between said antenna attaching means and said feeding means is adjusted.

3. The antenna apparatus according to claim 1, wherein antenna attaching means selected from a plurality of antenna attaching means having a different length is fixed to the main body of the mobile radio communication apparatus, so that a space between said antenna attaching means and said feeding means is adjusted.

4. An antenna apparatus for use in a mobile radio communication apparatus comprising:

an antenna having a helical antenna and a mono-pole antenna combined through an insulating member to have a long, thin shaft-like shape;

antenna attaching means for attaching said antenna to a main body of a mobile radio communication apparatus, having a cylindrical shape to be concentric with said antenna, and to hold an outer peripheral surface of said antenna slidably to be conductive to said helical antenna at the time of containing said antenna; and feeding means, having electrodes facing to the outer peripheral surface of said antenna attaching means, for feeding electrical power to said mono-pole antenna at the time of extending said antenna and forming capacitance at said electrodes with the outer peripheral surface of said antenna attaching means at the time of containing said antenna.

5. A method for generating electrostatic capacitance comprising:

attaching an antenna, having a helical antenna and a mono-pole antenna combined through an insulating member, to a mobile radio communication apparatus through an antenna attaching member;

making said mono-pole antenna and a feeding member conductive at the time of extending said antenna;

making said helical antenna and said antenna attaching member conductive at the time of containing said antenna; and generating electrostatic capacitance in a space between said antenna attaching member and said feeding member.

6. The method for generating electrostatic capacitance according to claim 5, wherein said antenna attaching means is screwed into a main body of the mobile radio communication apparatus to adjust an attaching position with respect to said mobile radio communication apparatus, so that a space between said antenna attaching member and said feeding member is adjusted.

7. The method for generating electrostatic capacitance according to claim 5, wherein a length of said antenna attaching member is adjusted, and a space between said antenna attaching member and said feeding member is adjusted.

8. A method for generating electrostatic capacitance comprising:

attaching an antenna, having a helical antenna and a mono-pole antenna combined through an insulating member, to a mobile radio communication apparatus through an antenna attaching member;

attaching said antenna to a main body of a mobile radio communication apparatus, having a cylindrical shape to be concentric with said antenna, through an antenna attaching member slidably holding an outer peripheral surface of said antenna;

providing electrodes facing to the outer peripheral surface of said antenna attaching member to a feeding member;

making said mono-pole antenna conductive at the time of extending said antenna;

making said helical antenna and said antenna attaching member conductive at the time of containing said antenna; and generating electrostatic capacitance in a space between said antenna attaching member and said feeding member.

* * * * *